US005904821A

United States Patent [19]

Blank et al.

[11] Patent Number: 5,904,821

[45] Date of Patent: May 18, 1999

[54] FUSED CHLORIDE SALT ELECTROLYSIS CELL

[75] Inventors: Howard M. Blank; Oswald Robert Bergmann, both of Wilmington, Del.; Walter John Simmons, Martinsburg, W. Va.

[73] Assignee: E. I. du Pont de Nemours and Company, Wilmington, Del.

[21] Appl. No.: 08/900,267

[22] Filed: Jul. 25, 1997

[51] Int. Cl.[6] ..... C25C 3/22

[52] U.S. Cl. ..... 204/245; 204/247; 204/294; 204/295

[58] Field of Search ..... 204/245–247, 204/295

[56] References Cited

U.S. PATENT DOCUMENTS

| | | | |
|---|---|---|---|
| 1,501,756 | 7/1924 | Downs . | |
| 2,056,184 | 10/1936 | Gilbert . | |
| 2,111,264 | 3/1938 | Gilbert . | |
| 2,194,443 | 3/1940 | Hardy et al. . | |
| 2,291,644 | 8/1942 | McNitt | 204/247 |
| 2,913,381 | 11/1959 | McFadyen et al. | 204/247 X |
| 3,037,927 | 6/1962 | Gallinger | 204/247 X |
| 3,507,768 | 4/1970 | Adaev et al. . | |
| 3,607,684 | 9/1971 | Kuhn | 204/62 |
| 3,930,981 | 1/1976 | De Nora et al. | 204/256 |
| 3,962,064 | 6/1976 | Brut et al. | 204/247 X |
| 4,192,724 | 3/1980 | Minami et al. | 204/67 |
| 4,584,068 | 4/1986 | Hinrichs et al. | 204/68 |
| 4,744,876 | 5/1988 | Bernard et al. | 204/245 |
| 5,064,513 | 11/1991 | Boutin et al. | 204/64 |

OTHER PUBLICATIONS

Alfred Klemm et al., Sodium and Sodium Alloys, *Ullman's Encyclopedia of Industrial Chemistry, Fifth Completely Revised Edition*, A24: Silicon Compounds, Inorganic to Stains, Microscopic, 277–278, 285–288, 296–298, 1985 No month available.

*Primary Examiner*—Donald R. Valentine

[57] ABSTRACT

An electrolytic cell is provided that increases current efficiency in the fused alkali chloride salt electrolysis process for producing chlorine and sodium or lithium by improved design of the cell's product collector, diaphragm and graphite anode.

12 Claims, 5 Drawing Sheets

(PRIOR ART - DOWN'S CELL)

(PRIOR ART - DOWN'S CELL)

FUSED CHLORIDE SALT ELECTROLYSIS CELL

FIELD OF THE INVENTION

This invention relates to an electrolytic cell for the electrolysis of fused alkali chloride salts for the production of alkali metals such as sodium and lithium.

DESCRIPTION OF THE RELATED ART

Electrolytic cells for the electrolysis of fused alkali chloride salts are used widely in industry to produce alkali metals such as sodium and lithium that are difficult to reduce from their compounds to a metallic state. A major cost for operating these cells is the cost of electric power. Since the early 1970s energy costs, including electric energy, have increased sharply. Development of more energy-efficient electrolysis processes, therefore, has become increasingly important during recent years.

The overall electric power requirements of the electrolytic processes are the total of the power requirements for the key operating elements in an electrolytic cell and the requirements for the ancillary operations. Although these ancillary operations are significant, the discussion below will focus only on the key elements involved in the electrolysis step, and in particular, the electrolysis of sodium and lithium.

The electrolytic recovery of sodium or lithium metals is typically carried out via non-aqueous molten chloride salt electrolysis. Except for the electrolyte composition and operating temperature, the electrolysis of sodium and lithium is very similar, and both processes are carried out in very similar equipment. While the discussion below will concentrate on sodium manufacture, it is to be understood that the features relating to cell design and operation also apply to lithium manufacture.

Most industrial installations for molten salt electrolysis of sodium have chosen the Downs cell design to carry out the process, originally disclosed in U.S. Pat. No. 1,501,756. A detailed description of this cell is given in Ullmann's Encyclopedia of Industrial Chemistry, 5th Ed., Vol. A24, VCH Verlagsgesellschaft, Germany, pp. 284–288 (1993). A typical industrial cell of this type is shown in FIG. 1. The electrolyte typically used is a mixture of sodium and calcium chlorides, or a mixture of sodium, calcium and barium chlorides, a mixture of salts being used to lower the melt temperature. An operating temperature of about 600 degrees C. is ordinarily employed.

A modern Downs cell typically contains four graphite carbon anodes and, concentrically surrounding each of them, cylindrical steel cathodes. In operation, sodium is deposited on the inside surface of the steel cathodes and chlorine gas is liberated at the graphite anodes. Typically, in a cell with four pairs of electrodes, the chlorine is collected in four shafts from the anodes while the sodium is collected in a single compartment covering all four cathodes.

To prevent back-mixing and reaction of the sodium and chlorine, a hydraulically permeable diaphragm is used to separate the cathode and anode compartments. It is typically made of steel mesh, and has a relatively short life of about two months because of corrosion and plugging with debris. When the diaphragm develops any major holes, it must be replaced because the holes lead to back-mixing and reaction of the sodium and chlorine, in turn reducing current efficiency and energy efficiency.

A major area for potential power savings is in the area of current efficiency. While the current efficiency of an electrolytic process could be above 99% of theory, most commercial molten salt sodium cells operate at relatively low current efficiencies. The cited Ullmann reference (p. 287) lists a typical current efficiency of 80 to 90%. These low values are due in part to commonly used diaphragms which allow a significant amount of back-mixing and reaction between freshly produced sodium metal and chlorine. This regenerates sodium chloride which must be electrolyzed a second time, thus reducing current efficiency. However, a diaphragm that is too restrictive for electrolyte movement would increase electrolyte voltage requirements. Finding a new diaphragm design that reduces back-mixing without increasing the electrolyte voltage requirements would result in power savings.

Another cause for low current efficiency is incomplete collection of the liquid sodium by the collector device used. As a result, a portion of the sodium will bypass the collector, float to the top of the electrolyte, and burn up as it contacts the air atmosphere at the electrolyte surface. The burning particles of sodium are referred to in the trade as "fireflies", and enable a visual measure of this sodium loss.

Current Downs cell designs also include a means for maintaining an appropriate thermal balance necessary for smooth operation. Typically, such cells have an external steel shell lined with firebrick of sufficient thickness to establish a temperature gradient across the cell wall that positions the freeze line for the electrolyte somewhere within the thickness of the brick lining. This makes the cell a self-sealing vessel in case a crack develops within the brick lining.

Some additional thermal balance temperature control may be provided by adding or removing external blankets of mineral wool. This may be required because, during normal operation the graphite anode is gradually consumed and decreases in size, causing the gap between the anode and cathode to increase. The greater electrode gap increases electrical resistance, voltage requirements and power consumption, in turn leading to greater heat generation. Therefore "older" cells, where their age refers to length of usage since the cells were constructed or rebuilt with new electrodes, tend to run hotter than "younger" cells. As a cell gets older, removal of the external insulating blankets may be required to maintain cell temperature in the desired range.

As an additional method of temperature control, the base of the cell (through which the anode current connection is made) may have provisions for some degree of water cooling. However, while helping to control overall thermal balance, anode base cooling frequently leads to undesirable cell bottom freezing and efficiency loss.

SUMMARY OF THE INVENTION

The present invention provides an improved electrolytic cell for the production of chlorine and sodium or lithium from fused chloride electrolytes. In one embodiment, the cell contains a product collector with a compartment for collecting the chlorine from each anode and a compartment for collecting the sodium or lithium from the cathode(s), the collector comprising a hydraulically permeable collection assembly extending below the top level of the cathode and containing impact surfaces which coalesce a portion of the sodium or lithium droplets in the electrolyte. In a second embodiment, the cell contains a diaphragm assembly between the anode and cathode comprising two adjacent hydraulically permeable structures, each hydraulically permeable structure containing a plurality of impact surfaces and openings angled upwards away from the nearest section of the adjacent hydraulically permeable structure. In a third embodiment, the cell contains graphite anode(s) wherein at least 10% of the average anode cross sectional area is replaced with a material with lower heat conductivity than graphite in that portion of the anode where it enters the cell.

BRIEF DESCRIPTION OF THE DRAWINGS

FIG. 4 illustrates a design wherein the anode is "necked", and FIG. 5 illustrates a design wherein the graphite anode is hollowed. FIG. 6A is an elevated view of an anode slotted in a pie-shape; FIG. 6B is a section of the anode taken at 6B—6B of FIG. 6A.

DETAILED DESCRIPTION OF THE INVENTION

This invention discloses substantial improvements to an electrolytic cell for the production of molten alkali metal and gaseous chlorine by the electrolysis of fused chloride salts. While these improvements are discussed separately, it is to be understood that one or more of these improvements may be incorporated in a single design of the improved electrolysis cell, and that, while the attached description is given in terms of electrolyzing sodium chloride, the improved cell may also be used for electrolysis of lithium chloride.

PRODUCT COLLECTION

Figure 1A:
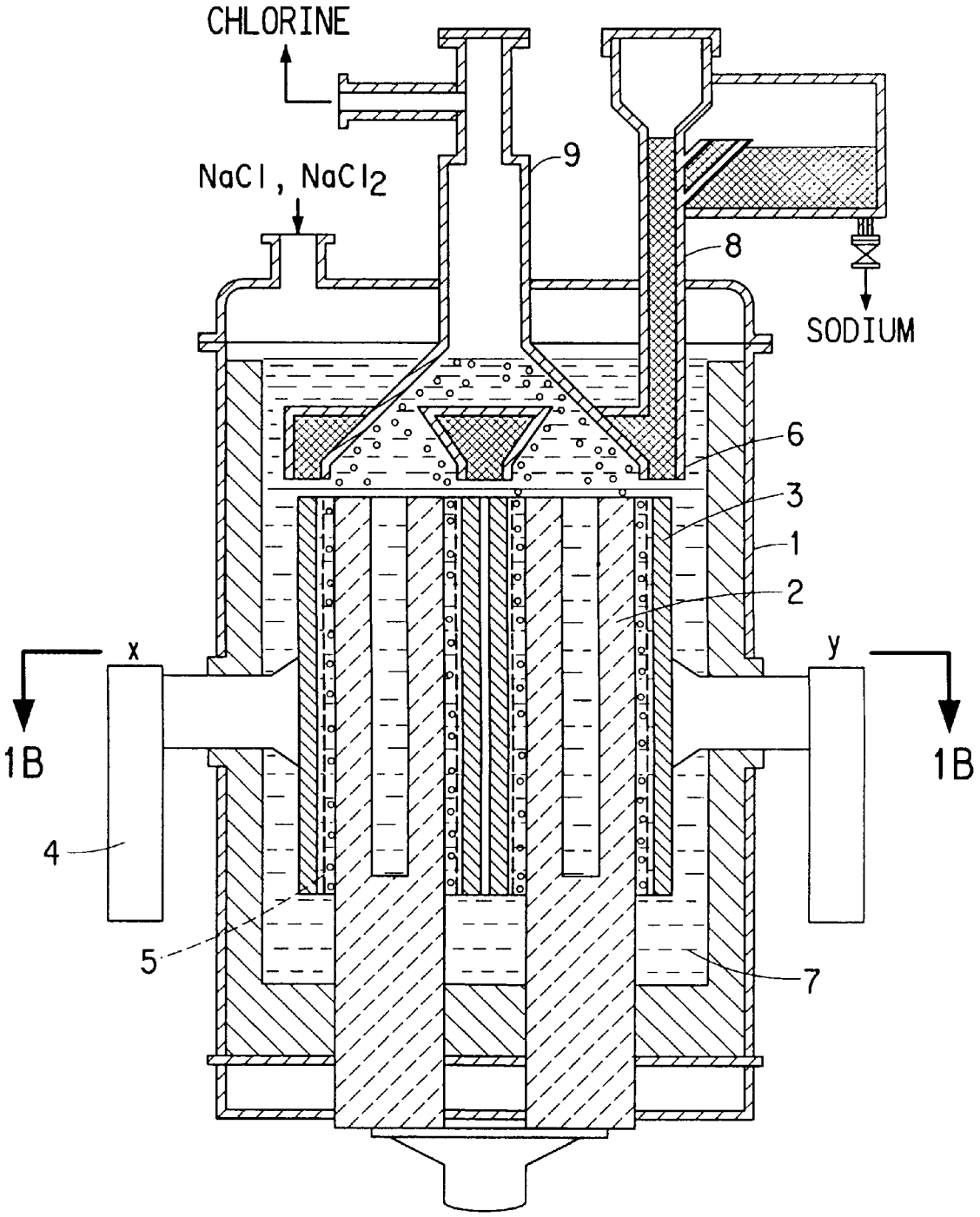
FIG. 1A and 1B are vertical and horizontal cross-sections, respectively, of a typical Downs cell having four sets of electrodes.
Figure 1B:
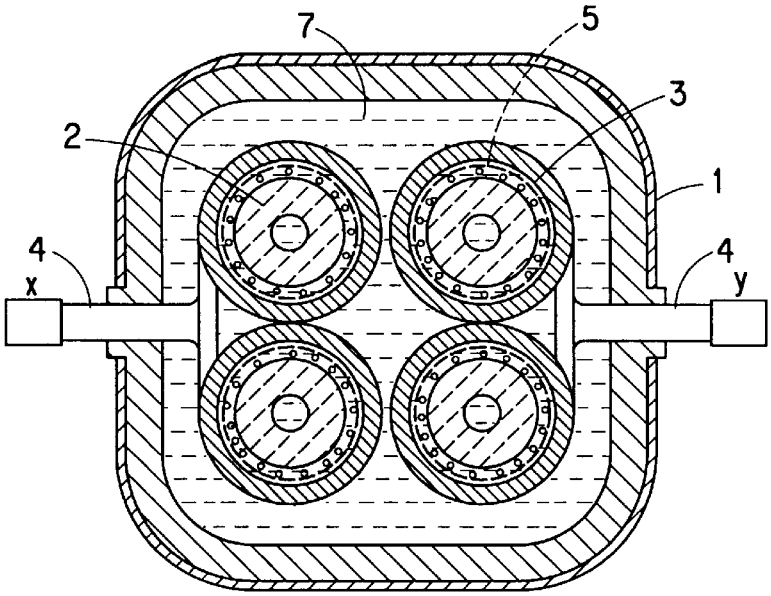

FIGS. 1A and 1B, respectively, illustrate in vertical and horizontal cross-section a typical Downs-type cell having four sets of electrodes. The cell has a cylindrical brick-lined, steel casing 1. Cylindrical graphite anodes 2 project upwardly through the bottom of the cell-casing 1. The cathodes 3 are steel cylinders having two diametrically opposed steel arms 4 which project outside the cell casing to serve as electric terminals. Cylindrical steel screen mesh diaphragms 5 are suspended about midway in the annular space between the anodes 2 and the cathodes 3. Annular collector ring 6 serves to collect molten metal which rises in the fused electrolyte 7 from the cathodes 3. Outlet tube 8 serves to carry the metal collected in collector ring 6 to the outside of the cell. Gas dome 9 carries gaseous anodic products formed by the electrolysis. Elements 5, 6, 8 and 9 are supported in the cell by means not shown.

In practice, a large box-like collector located above the electrodes contains separate compartments located above each of the anodes to collect its production of chlorine gas, and contains a single outer compartment covering all of the cell's cathodes to collect their molten sodium. The outer sodium compartment is an inverted box-like convex section with an inclined roof, located so to collect the sodium globules as they rise to the surface of the heavier molten salt. That is, the sodium collector typically covers all the area outside the diaphragms which separate each of the anodes and cathodes, and extends horizontally to slightly beyond the outer edge of the four-unit cathode assembly. For simplicity, most references only show a cell with a single pair of electrodes and corresponding collector, but use the same principles as described above.

Typical prior art references show the edge of the sodium collector extending downward only to about the same height as the cathode. However, designs that extend the sodium collector only as far as the cathode top allow some portion of the sodium to escape laterally beyond the outer edge of the collector and burn up upon contact with the air, representing a significant sodium yield loss and current efficiency loss. In addition, the sodium oxides so produced lead to an increased oxygen content in the electrolyte, in turn leading to increased anode oxidation, reduced anode life and reduced cell life.

In the cell design of this invention, this yield loss is reduced or prevented by providing a hydraulically permeable collection assembly extending from the outer edge of the alkali metal collection compartment downwardly below the top of the cathode to reduce sodium losses, with a design that allows sufficiently free electrolyte movement. This assembly comprises a member at the outer edge of the alkali metal collection compartment and extending downwardly to a point below the top of the cathode(s). This member has a plurality of impact surfaces angled upwards toward the interior of the collector. The overall area of the openings in the "skirt" assembly is sufficient to allow adequate flow of electrolyte. Preferably at least 50% of the total cross sectional area are openings to provide electrolyte flow.

Preferably, the above collection assembly also includes a secondary surrounding hydraulically permeable member such as, but not limited to, a mesh screen abutting the impact surfaces. Still more preferably, the above collection assembly is made up of a combination of louvers angled upwards toward the center of the cell and surrounded by a metallic mesh screen abutting the louvers.

Figure 2:
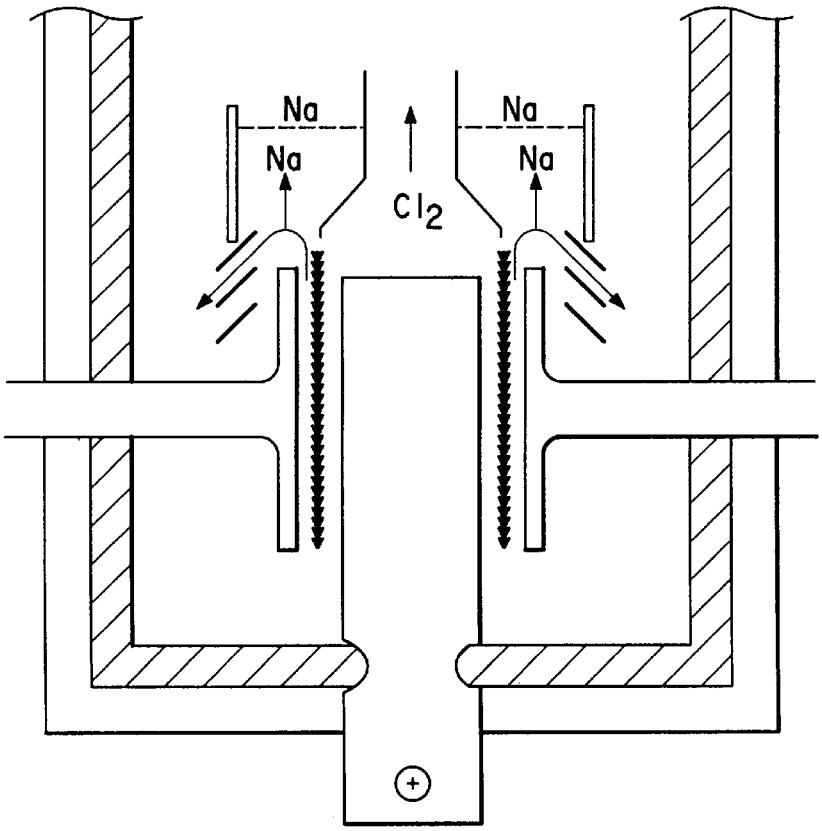
FIG. 2 illustrates a modified collector assembly, diaphragm, and anode in accordance with the invention.
Figure 3C:
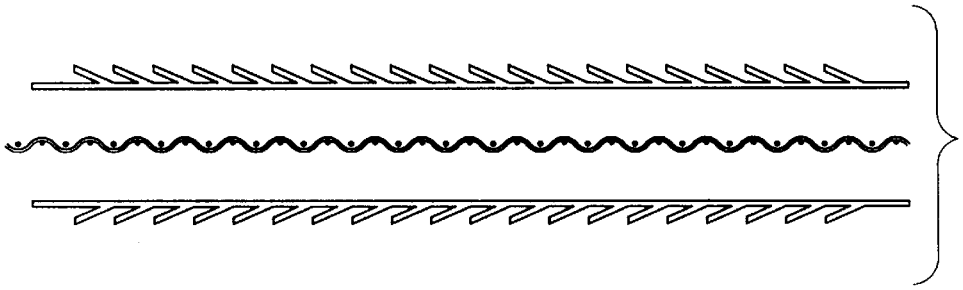
FIG. 3C is an exploded view of FIG. 3B.
Figure 3B:
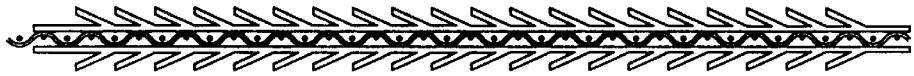
FIG. 3B is a section of the diaphragm taken at 3B—3B of FIG. 3A.
Figure 3A:
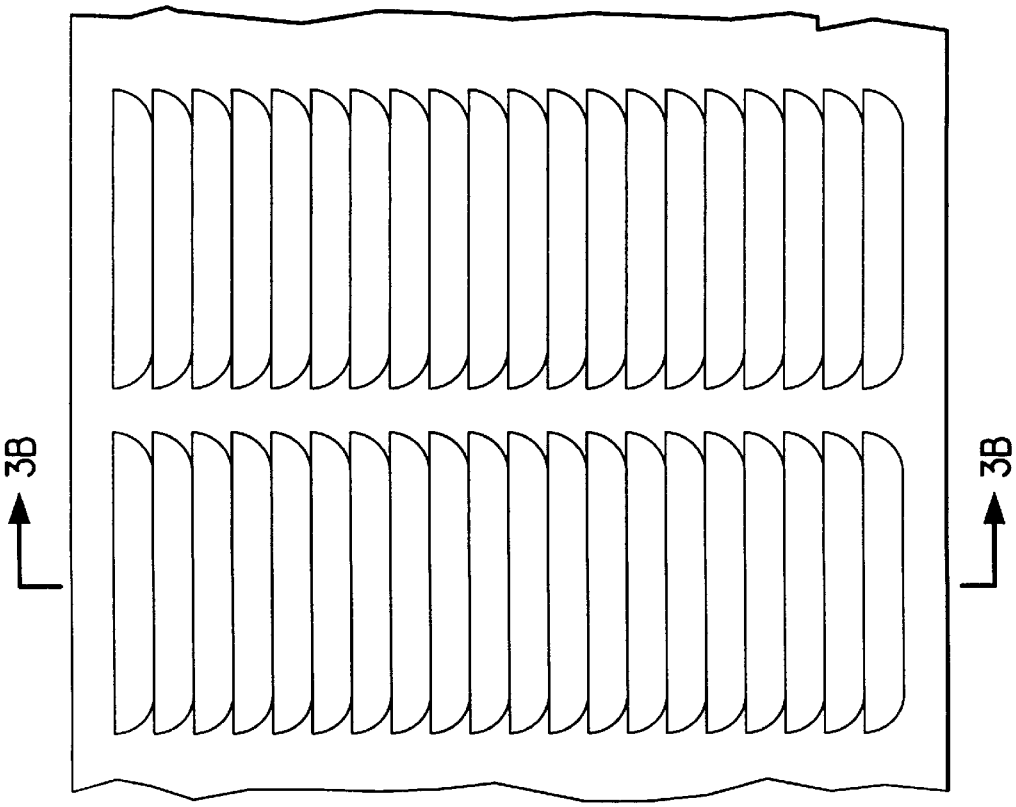
FIG. 3A illustrates a typical chevron-type diaphragm in elevation.

FIG. 2 illustrates a modified collector system, diaphragm, and anode that may be used in practicing the invention. The modified collector assembly is made of louvered units fastened to the outer edge of the sodium collector compartment, with the louvers angled upward toward the center of the cell and abutted by a mesh screen surrounding the louvers. The modified diaphragm is an assembly made of back-to-back louvered units with the louvers angled oppositely upward from the interior of the diaphragm assembly. The illustrated anode is necked to reduce the area for heat transfer and heat loss through the anode. FIG. 3 illustrates a typical chevron type of diaphragm, in face and profile views, that also may be used in practicing the invention.

The design illustrated in FIGS. 2 and 3 permit an adequate outward flow of the circulating electrolyte through the louvers and/or screen, while keeping the sodium droplets inside the skirt where they impinge on the louvers, coalesce and subsequently rise and merge with the main body of collected sodium inside the collector. The metal screen acts as a second impingement and coalescing surface for the sodium droplets. The louvers also direct hot electrolyte downward, thus keeping the bottom of the cell hotter and reducing the tendency for cell bottom freezeups. The "pockets" formed by the connection points between the louvers and the outer screen have the added benefit of serving to collect a portion of any particulate matter in the electrolyte, reducing their tendency to foul the diaphragm between the anode and cathode and cause problems in cell operation.

A plant trial demonstration of the improved collection skirt assembly resulted in a surprising increase in sodium production and current efficiency compared to typical Downs cells, as illustrated in Example 1.

IMPROVED DIAPHRAGM

Current industrial practice uses a steel-mesh screen as a diaphragm to separate the cathode and anode compartments so as to prevent back-mixing and reaction of the cathodically produced alkali metal and anodically produced chlorine. The useful life of such diaphragms is only about two months. Such diaphragms are of limited effectiveness, with groups of cells showing typical current efficiencies in the range of 80% to 90%.

The diaphragm designs of the current invention overcome these limitations of the prior art. They provide a diaphragm assembly comprising two concentric and adjacent cylindrically shaped structures, each cylindrically shaped structure containing a plurality of impact surfaces and openings angled upwards away from the nearest section of the adjacent cylindrically shaped structure. That is, the impact surfaces and openings are positioned so that upward flows of chlorine bubbles or sodium droplets around either side of the diaphragm are directed away from the point of adjacency of the two structures. By "adjacent" or "adjacency" in reference to this diaphragm design is meant that the two cylindrically shaped structures are nested one inside the other and are either separated by a relatively small space or else touch each other. Optionally there may be a mesh screen or other hydraulically permeable means between the two adjacent cylindrical shapes. The overall area of the openings in the cylindrical shapes should be sufficient to allow adequate flow of electrolyte, preferably at least 30% of the total cross sectional area for flow. With this improved design, back mixing of sodium and chlorine is reduced without significantly impeding electrolyte flow.

Preferably, the two concentric and adjacent cylindrically shaped structures contain impact surfaces comprising louvered elements wherein the slats in the adjacent louvers form a substantially V-shaped or chevron pattern, as illustrated in FIGS. 2 and 3. By "substantially V-shaped" is meant that the upward-angled slats in the adjacent louvers may use non-symmetric slant angles or spacings rather than forming an exact mirror image pattern of one with the other, so long as the directions of electrolyte flow relative to the diaphragm are not substantially changed compared to the V-shaped design, and so long as electrolyte flow is not thereby impeded. By a "chevron" pattern is meant a V-shaped slat design with symmetric slat angles and spacing. Optionally, the slats in the two adjacent louvered elements are separated by a mesh screen.

It has been found preferable to install the diaphragm assembly of this invention in a self-centering and self-aligning mode by use of strategically placed spacers. This permits better alignment of the assembly between the anode and cathode.

The improved diaphragm design utilizing a chevron slat design with the optional inner mesh screen resulted in a significant increase in current efficiency compared to typical Downs cells during plant trials (later shown as Example 2).

IMPROVED ANODE DESIGN

A related problem affecting current efficiency is heat control. The bottom of the cell is specially prone to freezeups because of the high heat loss from the bottom of the cell, primarily due to the higher heat conductivity of the graphite anodes as compared to the insulating firebrick. This causes a gradual buildup of solid frozen material on the cell floor. When this buildup is large enough to interfere with cell operation, it can be removed by temporarily removing the diaphragm, resuming the flow of electricity and allowing the sodium and chlorine to recombine at will. The electricity fed to the cell is then effectively used only to heat the cell, the higher cell temperature then melting the layer on the cell floor. When this is accomplished, the diaphragm can be reintroduced and production resumed. The current loss during the period of non-production represents a significant loss of overall current efficiency.

While the above problem in heat control could be minimized by cell designs incorporating a localized heat transfer system to only affect the temperature of the cell bottom, this solution would lead to a complicated cell bottom design, a special heat transfer system, and the use of a heat transfer fluid which would not cause a dangerous condition in case of sodium penetration through the vessel walls.

In the electrolytic cell design of this invention, this problem in heat control and the resultant non-production time is minimized by an improvement in the design of the graphite anode, whereby the bottom of the anode is altered to reduce its ability to transfer heat away from the cell bottom. This is done by (i) reducing the horizontal cross section of the highly heat-conductive graphite as it transverses the cell bottom, and/or (ii) replacing this part of the graphite with a less conductive material such as a ceramic or cement material. Either solution will effectively reduce the path for heat transfer, and hence heat loss from the cell, thereby reducing the possibility of cell bottom freezeups.

If approach (i) is selected, the horizontal cross sectional area of the graphite transversing the cell bottom is reduced by at least about 10% relative to the rest of the graphite anode to have a noticeable beneficial effect. While this design change also reduces the path for electricity flow, the electrical conductance of the graphite is sufficiently high so that the overall flow of electricity is not significantly impeded. At most there may be a slight local increase in heat generation at this point due to increased local electrical resistance, which would also help to prevent freezeups at the cell bottom.

Figure 4:
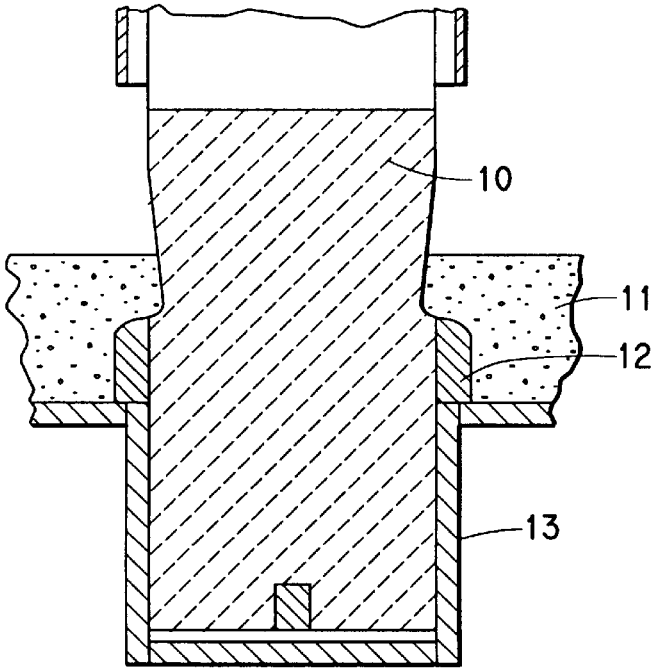
FIGS. 4, 5 and 6A and 6B illustrate various designs for reducing heat loss through the anode.

There are a number of ways in which the cross sectional area of the bottom of the anode can be reduced or replaced with a less heat-conductive material. This invention is not limited to a particular way of doing this. For example, the anode outer diameter can be reduced or narrowed at this point to form a neck as illustrated in FIG. 4 wherein graphite anode 10 is "necked" to reduce heat flow. The anode is imbedded in a suitably resistant cement cell base 11 and held by a positioning ring 12. Current is supplied to the anode through the steel housing 13.

Figure 5:
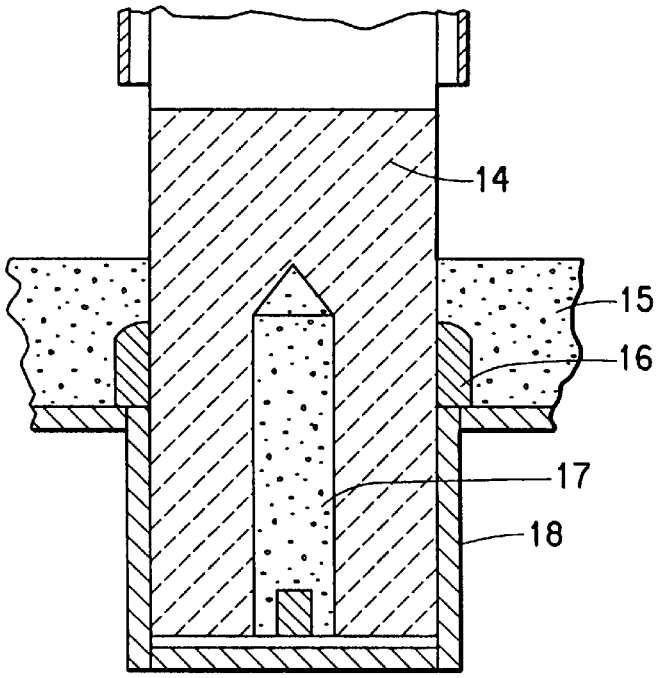

Alternative FIG. 5 illustrates a design wherein graphite anode 14 is hollowed out to reduce heat flow. The anode is imbedded in a suitably resistant cement cell base 15 and held by a positioning ring 16. The hollowed out portion of the anode 17 is filled with a material having lower heat conductivity than the graphite. Current is supplied to the anode through the steel housing 18.

Figure 6B:
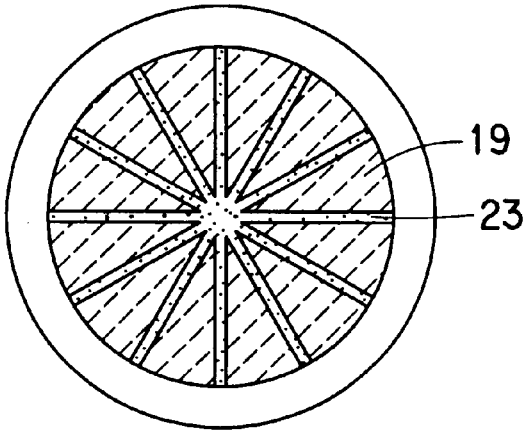
Figure 6A:
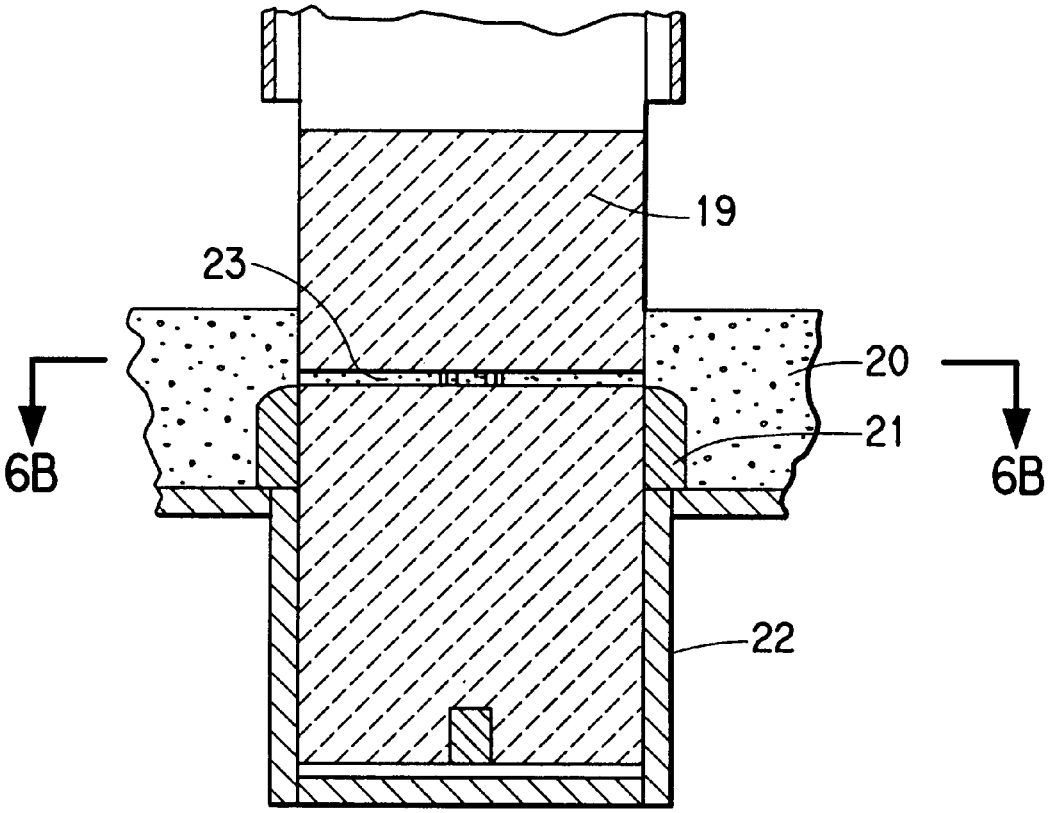

In yet another embodiment, FIG. 6 illustrates a design wherein graphite anode 19 is slotted in a pie-shaped fashion to reduce heat flow. The anode is imbedded in a suitably resistant cement cell base 20 and held by a positioning ring 21. Current is supplied to the anode through the steel housing 22. The slotted portion removed is replaced with a material 23 having a lower heat conductivity than the graphite. Other methods of reducing the cross sectional area of the anode bottom will be apparent to those skilled in the art.

Having described the invention, it is further illustrated, but not limited, by the following examples.

EXAMPLES

Example 1

A commercial size Downs-type cell with four sets of electrodes, similar to that shown in FIG. 1, was modified for this trial.

Before modification, the outer skirt of the collector ring consisted of solid metal extending downward to a level approximately even with the top of the cathode. For this trial, an additional section was bolted to the outer bottom of the existing skirt and extended it down by about 200 mm. The additional section was made as follows:

A louvered steel plate was made of 3 mm thick metal by forming horizontal slats with a vertical spacing of about 50 mm and a slat width of about 75 mm. The slats were angled upwards toward the center of the anode at 45 degrees to the horizontal. A cross section of the modified collector, as installed, is shown in FIG. 3.

Prior to the installation of the modified collector skirt, this commercial cell typically produced about 1130 to 1240 lbs. of sodium per 16 hours of operation, for an average of about 1200 lbs. of sodium, corresponding to 87.3% current efficiency. (At a current consumption of 45,500 amperes, 100% current efficiency would correspond to 1377 lbs. of sodium per 16 hours.) After installation of the modified collector skirt, over the next 12 days production of sodium averaged about 1270 lbs. of sodium per 16 hours, an increase of about 6%. Current efficiency improved to 93.6%. Cell voltage was unaffected. During the period of this trial, the remaining (unmodified) Downs cells continued to average about 87% current efficiency, indicating that the improvement in the modified cell was a result of the installation of the new skirt. Along with the increased current efficiency, the cell having the modified collector skirt showed a major reduction in the number of "fireflies" (the particles of sodium burning on the electrolyte surface).

Example 2

A second commercial size Downs-type cell with the same design as that used in Example 1 was modified for this trial. Before modification, the diaphragm in this cell consisted of a steel mesh screen extending downward from the collection hood to a level approximately even with the bottom of the anode. For this trial, this diaphragm was removed and replaced with a diaphragm of similar size and overall shape which was made as follows:

Two cylindrical louvered steel units were made so as to nest one inside the other, with louvered slats 25 mm long and 3 mm wide. The slats were angled upwards at about 60 degrees from the horizontal, but in opposite directions so as to form a chevron pattern. A steel mesh screen was placed in between the two units. The open area for electrolyte flow was about 50% of the total cross sectional area. A profile and cross-sectional view of this assembly is shown in FIG. 3.

Prior to the installation of the new diaphragm, this commercial cell typically produced about 1130 to 1240 lbs. of sodium per 16 hours of operation, for an average of about 1200 lbs. of sodium, corresponding to 87.3% current efficiency. After installation of the new diaphragm, over the next 8 days production of sodium averaged about 1260 lbs. of sodium per 16 hours, an increase of about 5%. Current efficiency improved to 91.5%. Cell voltage was unaffected. During the period of this trial, the remaining (unmodified) Downs cells continued to average about 87% current efficiency, indicating that the improvement in the modified cell was due to the installation of the new diaphragm of the invention.

APPENDIX

INVENTORS

This patent proposal is submitted by Oswald R. Bergmann, Howard M. Blank and Walter J. Simmons.

BAR DATES

Portions of this invention were used for the commercial production of sodium and chlorine in September 1996.

RELEVANT PATENTS

U.S. Pat. No. 1,501,756 is the original Downs patent. The FIGURE shows the outer edge of the sodium collector extending slightly below the top of the cathode, with a permeable section below the impermeable section, but more recent references typically show the edge of the sodium collector as extending downward only to the same height as the cathode.

U.S. Pat. No. 3,507,768 (Adaev et al, 1970) discloses an electrolytical cell for the production of sodium and chlorine from fused salts where the major improvement is a hollow annular anode containing an anode cooler, where the anode is assembled from circumferentially arranged graphite bars.

U.S. Pat. No. 4,584,068 (Degussa, 1986) discloses an electrolytic cell for the production of sodium and chlorine from fused salts where the major improvements are a cell double bottom and a revised anode housing to improve heat transfer and allow operation at a variable current load.

What is claimed is:

1. An electrolytic cell for the production of chlorine and sodium or lithium from fused chloride electrolytes containing a cathode, an anode, and a product collector with (a) a compartment for collecting the chlorine from each anode and (b) a compartment for collecting the sodium or lithium from the cathode(s), wherein a hydraulics permeable collection assembly extends below the top level of the cathode, said assembly containing impact surfaces angled upward toward the interior of the collector which coalesce a portion of the sodium or lithium droplets in the electrolyte.

2. The electrolytic cell of claim 1, wherein a collection assembly is attached to the outer edge of the sodium or lithium collection compartment extending downwards to a point below the top of the cathodes(s), said assembly having a plurality of impact surfaces and openings angled upwards toward the interior of the cell such that at least 50% of the total cross sectional area are openings to provide electrolyte flow.

3. The electrolytic cell of claims 1 or 2 in which the impact surfaces are abutted by a secondary surrounding hydraulically permeable member.

4. An electrolytic cell for the production of chlorine and sodium or lithium from fused chloride electrolytes, having a diaphragm assembly between an anode and a cathode, said assembly comprising two adjacent hydraulically permeable structures, each hydraulically permeable structure containing a plurality of impact surfaces and openings angled upwards away from the nearest section of the adjacent hydraulically permeable structure.

5. The electrolytic cell of claim 4 in which the two adjacent hydraulically permeable structures are concentric cylindrically shaped structures.

6. The electrolytic cell of claims 4 or 5 wherein the diaphragm assembly is comprised of louvered elements and wherein slats in the louvered elements form a substantially V-shaped pattern.

7. The electrolytic cell any one of claims 1, 2, 4, or 5, containing at least one graphite anode mounted in the cell base, wherein at least about 10% of the average anode horizontal cross sectional area where it enters the cell is replaced by a material with lower heat conductivity than graphite.

8. The electrolytic cell of claim 7 containing a diaphragm assembly between the anode and cathode, said assembly comprising two concentric adjacent cylindrically shaped structures, each cylindrically shaped structure containing a plurality of impact surfaces with openings angled upwards away from the nearest section of the adjacent cylindrically shaped structure.

9. An electrolytic cell for the production of chlorine and sodium or lithium from fused chloride electrolytes of said cell containing graphite anode(s), wherein at least about 10% of the average anode cross sectional area is replaced in that portion of the anode that enters the cell by a material with lower heat conductivity than graphite.

10. The electrolytic cell any one of claims 1, 2, or 9 containing a diaphragm assembly between the anode and cathode, said assembly comprising two concentric adjacent cylindrically shaped structures, each cylindrically shaped structure having a plurality of impact surfaces and openings angled upwards away from the nearest section of the adjacent cylindrically shaped structure.

11. The electrolytic cell of claim 10, wherein the diaphragm assembly has louvered elements formed by slats, wherein the slats form a substantially V-shaped pattern.

12. The electrolytic cell any one of claims 1, 2, 4, 5, or 9 having a diaphragm that is self-centering and self-aligning.

* * * * *